US006471568B1

(12) United States Patent
Wang

(10) Patent No.: US 6,471,568 B1
(45) Date of Patent: Oct. 29, 2002

(54) ECCENTRIC-SWINGING DEVICE FOR A SANDING MACHINE

(76) Inventor: Chun-Hsiang Wang, PO Box 82-144, Taipei (TW)

( * ) Notice: Subject to any disclaimer, the term of this patent is extended or adjusted under 35 U.S.C. 154(b) by 49 days.

(21) Appl. No.: 09/637,198

(22) Filed: Aug. 14, 2000

(51) Int. Cl.[7] ..... B24B 7/02; B24B 21/22
(52) U.S. Cl. ..... 451/168; 451/304; 451/361
(58) Field of Search ..... 451/162, 164, 451/168, 297, 304, 340, 361, 451

(56) References Cited

U.S. PATENT DOCUMENTS 3,416,261 A * 12/1968 Sherman et al. ..... 451/168
4,939,870 A * 7/1990 Wang ..... 451/296
5,512,009 A * 4/1996 Earl ..... 451/299
6,283,841 B1 * 9/2001 Wang ..... 451/296
6,299,512 B1 * 10/2001 Costa et al. ..... 451/300

* cited by examiner

*Primary Examiner*—Timothy V. Eley
(74) *Attorney, Agent, or Firm*—Leong C. Lei

(57) ABSTRACT

A driven roller is mounted with an eccentric-swinging device which has the function of swinging, and the eccentric-swinging device comprises a floating frame, a transmission structure, and a flat plate mounted onto the machine body of the device, and the center section of the floating frame is mounted with a shaft seat, and the bottom surface within a support frame is mounted with corresponding bearings such that the shaft seat holds the bearings formed into a rotating support for the floating frame, and in between the floating frame and the flat plate, a spring which can be pulled downward is mounted, and the transmission structure is attached to the floating frame, corresponding to one lateral side of the flat plate, the transmission structure is synchronously driven by the shaft rod of the driven roller, and the flat plate is mounted with a rotatable shaft center, wherein a free end of the shaft center forms into an eccentric post, and a bearing urging the top face of the flat plate is mounted onto the eccentric post, thereby the sanding belt produces a reciprocating sanding movement.

3 Claims, 5 Drawing Sheets

ECCENTRIC-SWINGING DEVICE FOR A SANDING MACHINE

BACKGROUND OF THE INVENTION (a) Technical Field of the Invention

The present invention relates to the technology field of sanding machine, and in particular, an eccentric-swinging device mounted onto a shaft rod of a roller of a sanding module.

(b) Description of the Prior Art

Sanding machine is a device used in sanding the surface of wood material. Referring to FIG. 1, there is shown a conventional sanding machine having a machine body 10 mounted with a working platform 15 on the top thereof One side of the platform 15 is provided with a sanding module 20 for the sanding of the surface of wood material. The sanding module 20 comprises a support frame 21 with two ends respectively mounted with a driving roller 22 and a driven roller 23. The driving roller 22 is connected to a motor 24 to drive a sanding belt 25 mounted around the driving roller 22 and the driven roller 23. The rotation of the sanding belt 25 polishes the material located on the working platform 15.

However, the sanding belt 25 of this conventional sanding machine provides a linear rotation, i.e., the position A on the sanding belt 25 moves horizontally to the point A'. Thus, the material thereon is polished in a linear manner. As the particles of the sanding belt 25 contain very tiny gaps, the entire surface of the material cannot be polished. In other words, capillary holes on the surface of the material cannot be effectively removed. Additionally, the size of the material and the exertion force of the sanding belt 25 on the material are not always constant, and the exhaustion of particles of the sanding belt 25 is not uniform. Thus, the surface of the sanding belt 25 is irregular and the polished surface of the material will have similar irregularities, and the quality of the entire surface of the polished material is reduced. Therefore, it is an object of the present invention to provide a swinging device for a sanding machine, which can mitigate the drawbacks of the conventional sanding machine.

SUMMARY OF THE INVENTION

Accordingly, it is an object of the present invention is to provide an eccentric-swinging device for a sanding machine, wherein a driven roller is mounted with an eccentric-swinging device which has the function of swinging, and the eccentric-swinging device comprises a floating frame, a transmission structure, and a flat plate mounted onto the machine body of the device, and the center section of the floating frame is mounted with a shaft seat, and the bottom surface within a support frame is mounted with corresponding bearings such that the shaft seat holds the bearings forming into a rotating support for the floating frame, and in between the floating frame and the flat plate, a spring which can be pulled downward is mounted, and the transmission structure is mounted to the floating frame, corresponding to one lateral side of the flat plate, the transmission structure is synchronously driven by the shaft rod of the driven roller, and the flat plate is mounted with a rotatable shaft center, wherein a free end of the shaft center forms into an eccentric post, and a bearing urging the top face of the flat plate is mounted onto the eccentric post, thereby the sanding belt produces a reciprocating sanding movement.

Yet another object of the present invention is to provide an eccentric-swinging device for a sanding machine, wherein the sanding effect to the polishing material is of high quality.

Other objects and advantages of the present invention will become more apparent from the following description taken in conjunction with the accompanying drawing.

DETAILED DESCRIPTION OF THE PREFERRED EMBODIMENT

Figure 1:
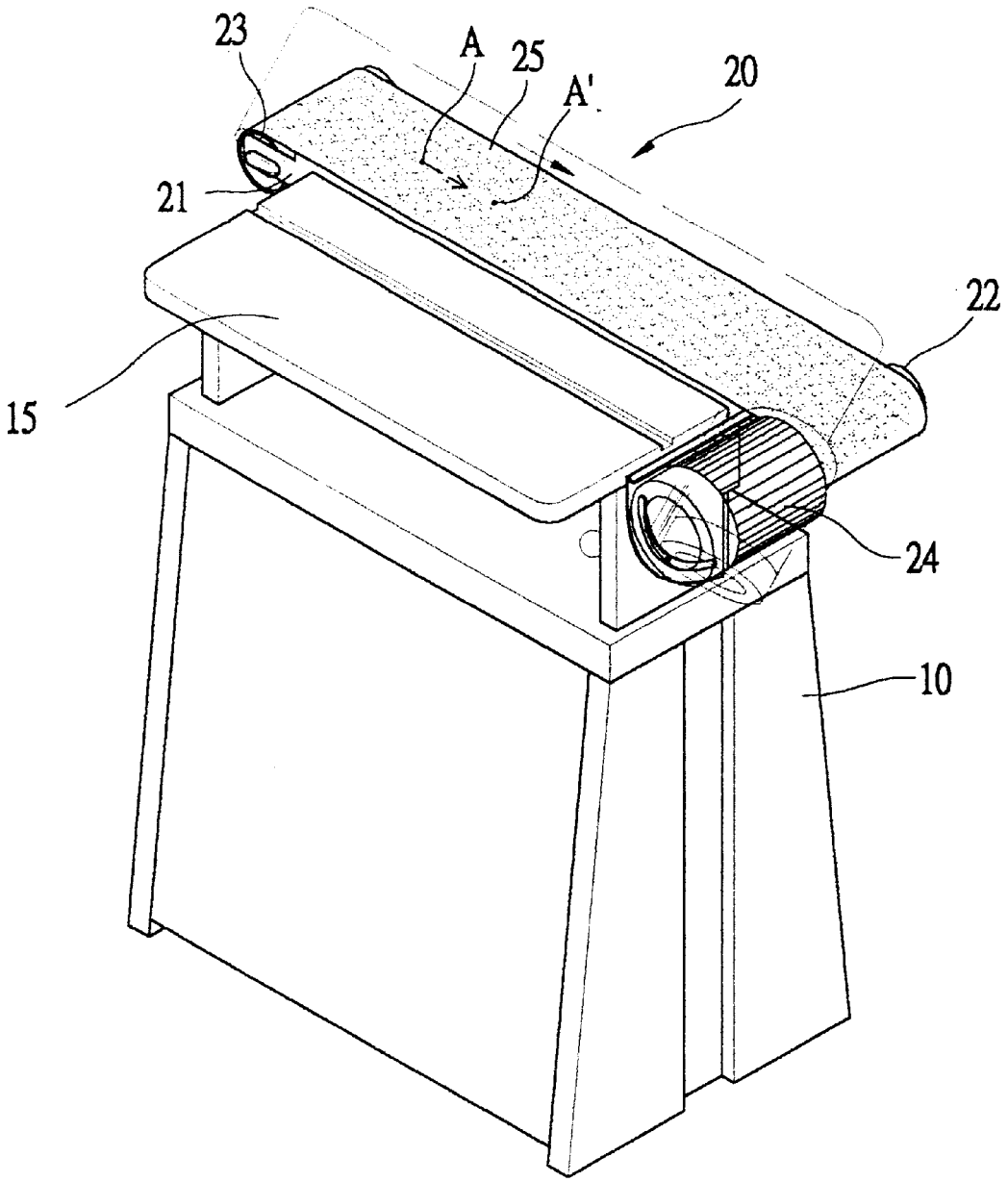
PRIOR ART FIG. 1
FIG. 1 is a perspective view of a conventional sanding machine, illustrating the component and working principle of the sanding machine.
Figure 2:
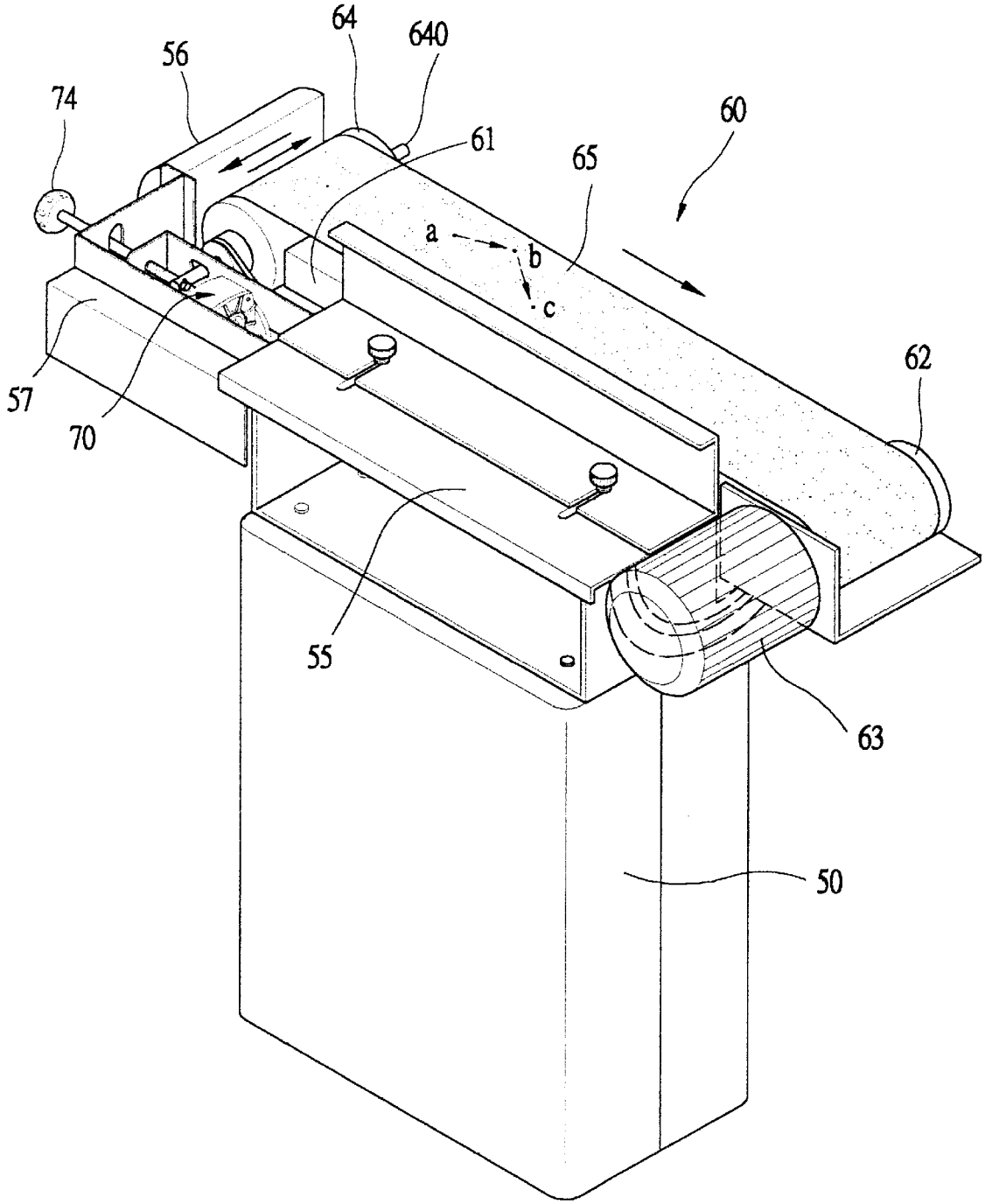
FIG. 2 is a perspective view of a sanding machine in accordance with the present invention, illustrating the entire structure of the machine.

Referring to FIG. 2, there is shown a sanding machine having a machine body 50 with a working platform 55 at the top end of the machine body. One lateral side of the working platform 55 is mounted with a sanding module 60 having a sanding belt 65. The sanding module 60 has a support frame 61 having two ends respectively mounted with a driving roller 62 and a driven roller 64, and the driving roller 62 is connected to a motor 63. The sanding belt 65 surrounds the driving roller 62 and the driven roller 64. Thus, when the sanding belt 65 is driven, material (not shown) on the working platform 55 is moved to polish.

Figure 3:
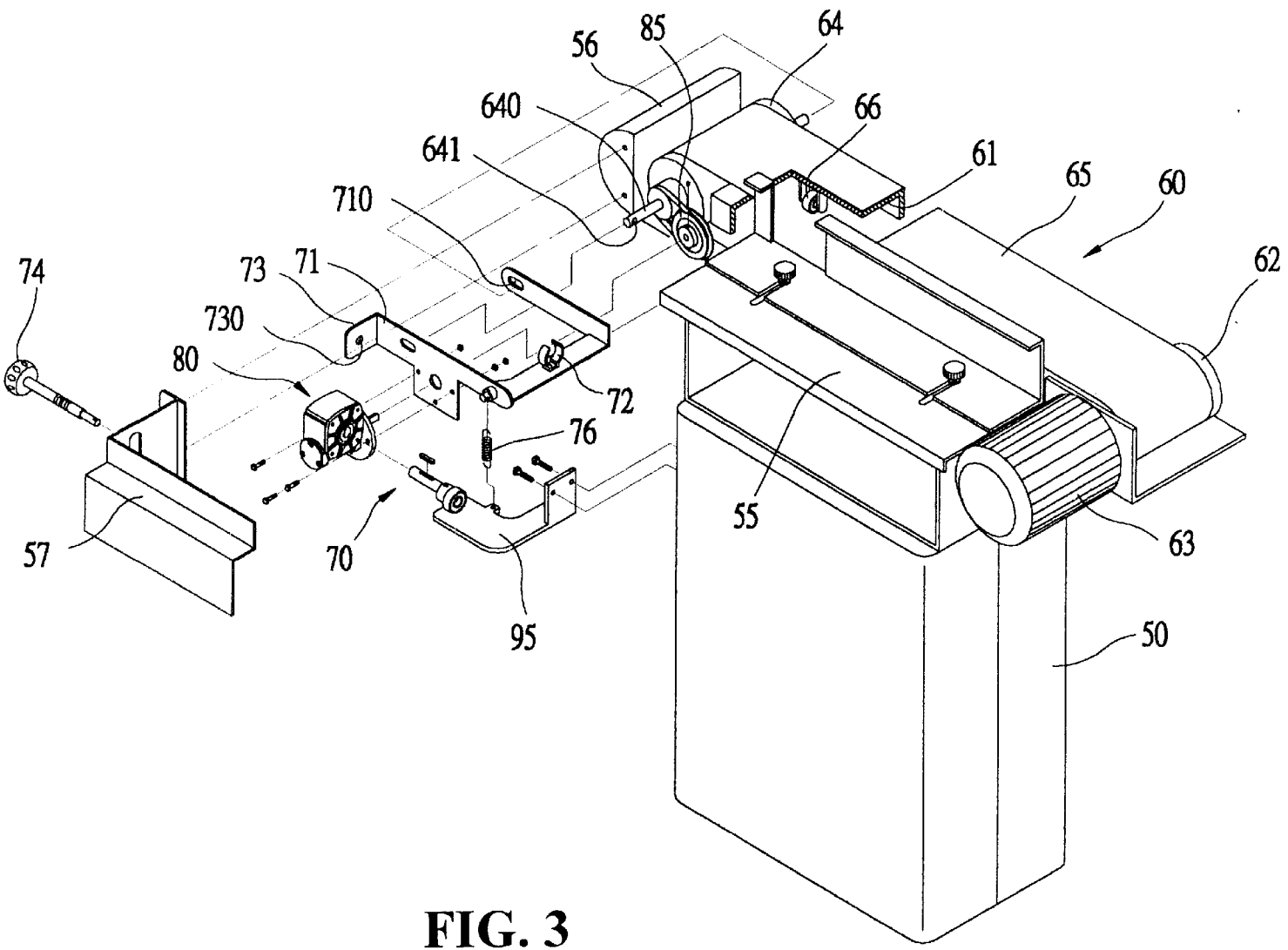
FIG. 3 is an exploded perspective view of the eccentric swinging device of the present invention, illustrating the components of the eccentric-swinging device and their respective location.

Referring to FIGS. 2 and 3, the shaft rod 640 of the driven roller 64 is mounted with an eccentric-swinging device 70 comprising a U-shaped floating frame 71, a transmission structure 80, and a flat plate 95 mounted onto the machine body 50, such that the driven roller 64 produces an eccentric motion as that produced by a see-saw.

The straight rod at the two lateral sides of the U-shaped floating frame 71 is formed with a long slot 710 for the pivotal mounting at the two ends of the shaft rod 640 of the driven roller 64. The center section of a horizontal rod of the floating frame 71 is mounted with a semi-circular shaft seat 72, wherein the shaft seat 72 can hold a bearing 66 located at the bottom face of a support plate 61 such that the floating frame 71 can reciprocate about the shaft seat 72 as the point of support. The end section of a vertical rod at one lateral side of the floating frame 71 is protruded out with a protruded plate 73 having a screw hole 730 for the mounting of an adjusting screw rod 74. The end section of the adjusting screw rod 74 can be pivotally mounted onto an insertion hole 641 provided on the shaft rod 640, thereby, the tightness of the sanding belt 65 is adjusted. In between the other end of the adjusting screw rod 74 of the floating frame 71, and the flat plate 75, a spring 76 is provided, such that the floating frame 71 is provided with a downward reaction force. The transmission structure 80 is located at one lateral side of the floating frame 71.

Figure 4:
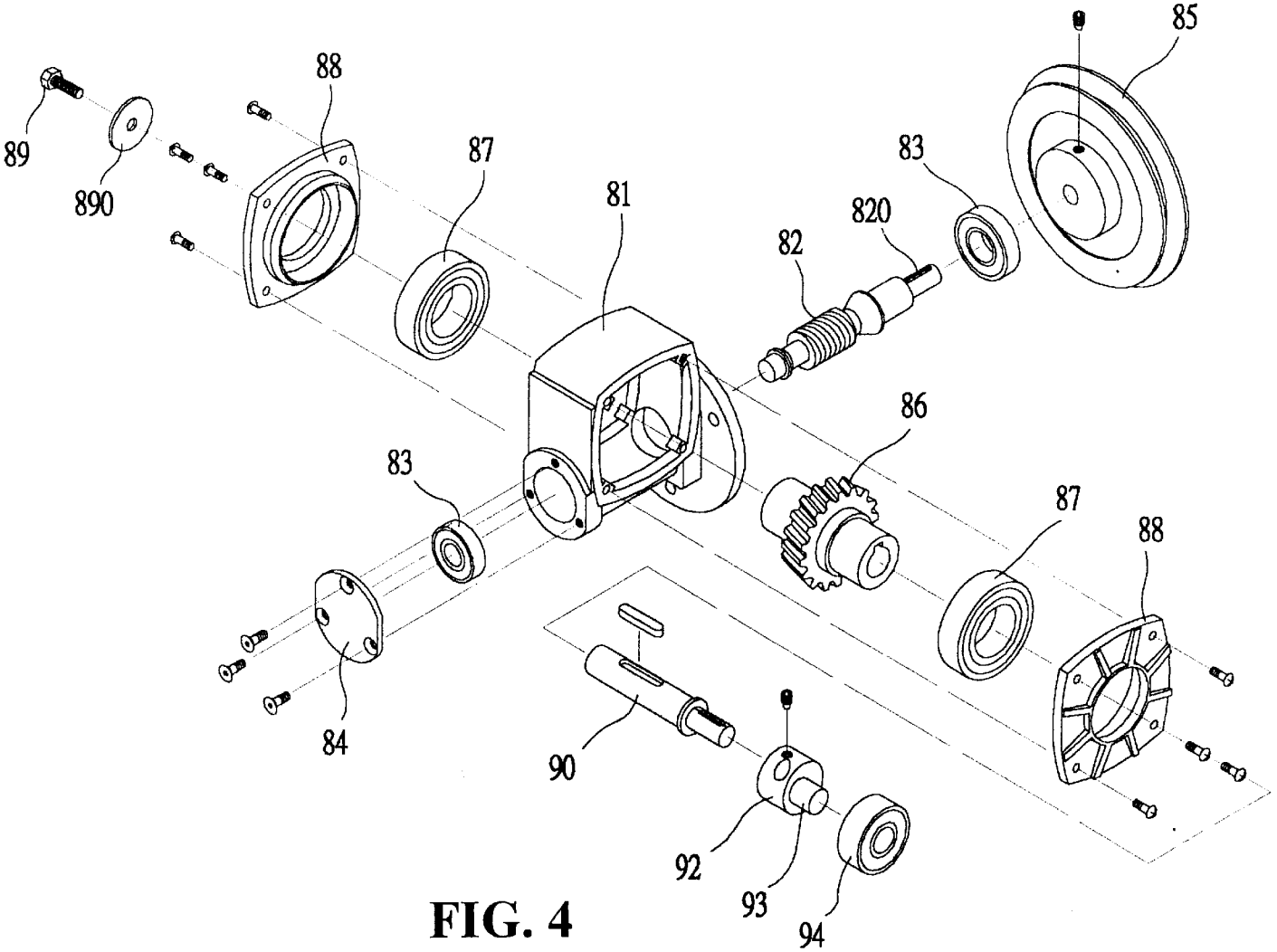
FIG. 4 is an exploded perspective view of the transmission structure, illustrating the components of the structure.

The transmission structure 80 is shown in FIG. 4. On a hollow frame body 81, bearings 83 are used to pivotally mount a worm 82 parallel to the driven roller 64. The worm 82, corresponding to one end of the shaft rod 640 of the driven roller 64, is mounted with a belted roller 85 connected to the shaft rod 640 with a belt such that the driven roller 64 can move the worm 82. The frame body 81, corresponding to the other end of the belted roller 85, is mounted with a lateral cover 84 for the protection of the worm 82. Besides, within the frame body 81, bearings 87 are used to pivotally mount to a worm gear 86, wherein the two ends of bearings 87 are respectively mounted to the cover plates 88 at the two lateral side of the frame body 81 to allow the worm gear 86 to engage appropriately with the worm 82. The other end of the worm 86 is mounted with a shaft center 90 protruded out of the cover plate 88. One lateral side of the machine body 50 is locked by using screw bolt 89 together with a positioning plate 890.

The free end of the shaft center 90 is mounted with a shaft sleeve 92 having an eccentric post 93, and a bearing 94 is mounted onto the eccentric post 93. The bearing 94 appropriately presses the flat plate 95 on the machine body 50. The machine body 50, corresponding to one end of the driven roller 64, is mounted with a front protection cover 56 and a lateral protection cover 57, wherein the lateral protection cover 57 has a long slot 570 for the mounting of the adjusting screw rod 74, thereby, the sanding belt 65 is driven to move in an eccentrical motion.

Figure 5:
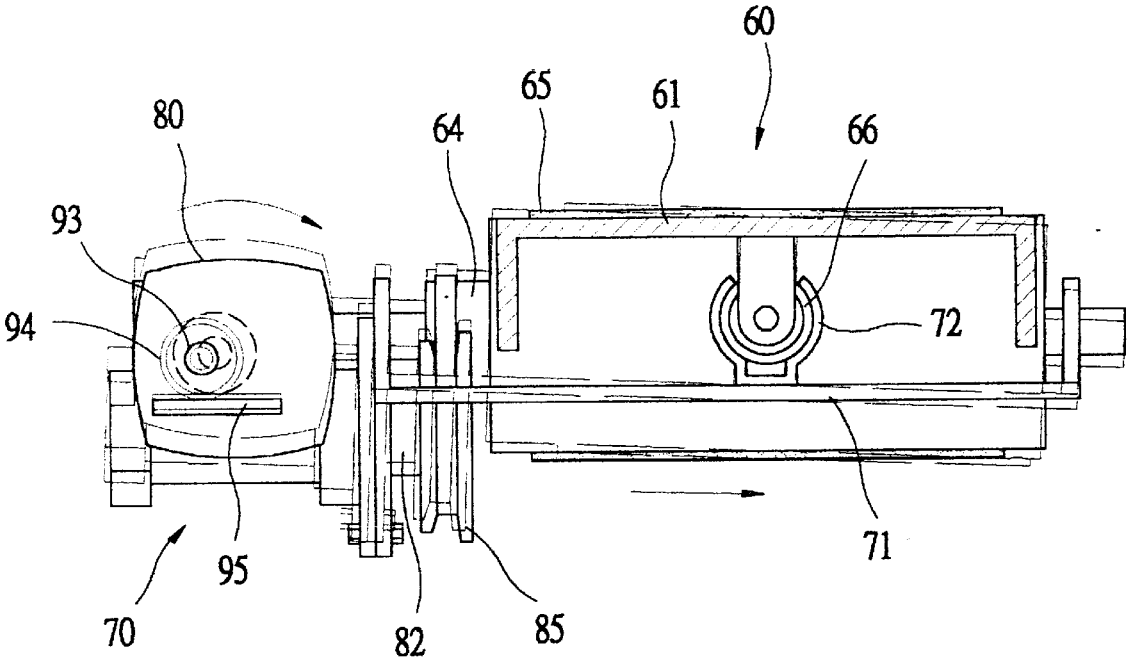
FIG. 5 is a schematic view of the present invention.
Figure 6:
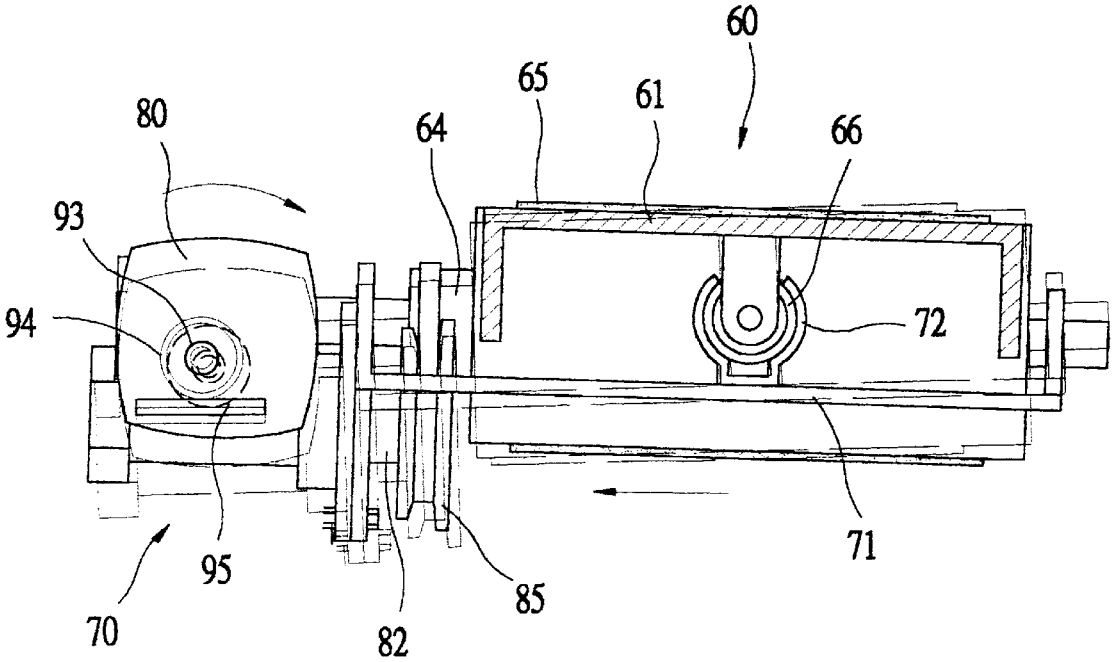
FIG. 6 is another schematic view of the present invention, illustrating another eccentric movement of the sanding module.

As shown in FIGS. 2, 5 and 6, when the sanding module 60 rotates, the driven roller 64 will rotate via the belt 65 to drive the belted roller 85 of the transmission structure 80, and the engaged worm 82 and worm gear 86 rotates synchronously, and the worm gear 86 causes the shaft center 90 to rotate, which causes the bearing 94 located on the eccentric post 93 to rotate eccentrically with respect to the flat plate 95. The action of the spring 76 causes the transmission structure 80 to drive the floating frame 71 and the driven roller 64 to move with the shaft seat 72 as the point of support.

When the eccentrical-swinging device 70 is higher than the center of the shaft rod, the sanding belt 65 of the driven roller 64 moves upward. When the eccentrical-swinging device 70 is lower than the center of the shaft rod 640, then the sanding belt 65 will slide away towards the other side. When the sanding belt 65, corresponding to one end of the driven roller 64, rotates, a reciprocating movement is produced. That is, as shown in FIG. 2, the point "a" on the sanding belt 6 moves to point "b" and then to point "c", which is a reciprocating sanding procedure. Thus, the capillary pores on the sanding surface are greatly reduced and the polished surface becomes smooth and fine. Due to the movement of the sanding particles, relatively uniform sanding is obtained, and the flatness of the sanding surface is improved. Thus, the entire sanding quality is upgrade.

While the invention has been described with a preferred embodiment, it will be clear to those skilled in the art that modifications and improvements may be made to the invention without departing from the spirit and scope of the invention. Therefore, the invention is not to be limited by the specific illustrative embodiment, but only by the scope of the appended claims.

I claim:

1. An eccentric-swinging device for a sanding device having a machine body mounted with a working platform at one end thereof, one lateral side of the working platform being a sanding module having a sanding belt, the sanding module having a support frame with two ends respectively mounted with a driving roller and a driven roller, the sanding belt surrounding the driving roller and the driven roller, wherein the driven roller with a shaft rod is mounted with an eccentric swinging device which provides an eccentrical movement, the eccentric-swinging device comprises a floating frame, a transmission structure and a flat plate mounted onto the machine body, a center section of the floating frame is provided with a shaft seat, and a bottom face of the support frame is mounted with corresponding bearings such that the shaft seat holds the bearings to form a rotating support for the floating frame, and in between the floating frame and the flat plate, a spring which can be pulled downward is mounted, and the transmission structure is located at the floating frame, corresponding to one lateral side of the flat plate, the transmission structure is synchronously driven by the shaft rod of the driven roller, and the flat plate is mounted with a rotatable shaft center, wherein a free end of the shaft center forms into an eccentric post, and a bearing urges the top face of the flat plate on the eccentric post, thereby the sanding belt produces a reciprocating sanding movement.

2. The eccentric-swinging device for a sanding machine as set forth in claim 1, wherein two lateral sides of the floating frame are provided with a long slot corresponding to the shaft rod of the driven roller, and an end section of the floating frame is protruded to form a protruded plate having a screw hole for the mounting of an adjustable screw rod, an end section of the adjustable screw rod is pivotally mounted to the shaft rod for the adjustment of tightness of the sanding belt.

3. The eccentric-swinging device for a sanding machine as set forth in claim 1, wherein the transmission structure has a worm parallel to the driven roller mounted by bearings within a frame body, and the worm, corresponding to one end of the shaft rod of the driven wheel, is mounted with a belted roller, and a belt is used to connect the belted roller to the shaft rod and the frame body, a lateral cover is mounted corresponding to a lateral side of the belted roller for protection thereof and within the frame body, a bearing is used to pivotally mount a worm gear, and two bearings are respectively mounted to the lateral cover at a side edge of the frame body, and the worm gear is appropriately in engagement with the worm, one end of the shaft center is mounted to the worm gear, and a screw bolt having a positioning plate is used to mount another end of the shaft center.

* * * * *